US009428954B1

(12) United States Patent
Jaskiewicz et al.

(10) Patent No.: US 9,428,954 B1
(45) Date of Patent: Aug. 30, 2016

(54) CORNER PAD AND ENTRYWAY HAVING THE SAME

(71) Applicant: Endura Products, Inc., Colfax, NC (US)

(72) Inventors: Tomasz Jaskiewicz, Winston-Salem, NC (US); George Heid, Charlotte, NC (US)

(73) Assignee: Endura Products, Inc., Colfax, NC (US)

( * ) Notice: Subject to any disclaimer, the term of this patent is extended or adjusted under 35 U.S.C. 154(b) by 0 days.

(21) Appl. No.: 14/717,181

(22) Filed: May 20, 2015

(51) Int. Cl.
*E06B 7/22* (2006.01)
*E06B 7/23* (2006.01)

(52) U.S. Cl.
CPC ..... *E06B 7/2312* (2013.01)

(58) Field of Classification Search
CPC ..... E06B 7/2312; E06B 7/2316; E06B 1/70; E06B 7/14; E06B 7/23
See application file for complete search history.

(56) References Cited

U.S. PATENT DOCUMENTS 3,851,420 A 12/1974 Tibbetts
4,076,262 A * 2/1978 Deventer ..... E06B 7/2316 277/569
4,411,104 A 10/1983 Aubin
6,219,971 B1 4/2001 Headrick
6,665,989 B2 12/2003 Bennett
D588,905 S 3/2009 Meeks et al.
8,127,500 B2 3/2012 Meeks et al.
8,240,090 B2 8/2012 Meeks et al.
8,555,551 B2 10/2013 Meeks et al.
8,813,427 B2 8/2014 Meeks
2008/0010904 A1* 1/2008 Meeks ..... E06B 7/2316 49/484.1
2009/0084041 A1 4/2009 Foster et al.

OTHER PUBLICATIONS

Steele Rubber Products, Windshield Weatherstrip, http://www.steelerubber.com/windshield-weatherstrip-60/0055-52, known at least as early as Mar. 16, 2013, last viewed Aug. 18, 2015, 1 pg.
Zoro Weatherstrip, http://www.zoro.com/i/G0455287/, known at least as early as Mar. 16, 2013, last viewed Aug. 18, 2015, 3 pgs.

* cited by examiner

*Primary Examiner* — Patrick Maestri
(74) *Attorney, Agent, or Firm* — Womble Carlyle Sandridge & Rice, LLP

(57) ABSTRACT

The present disclosure describes a corner pad for an entryway. The corner pad may have a mounting surface configured for attachment to a frame member. The corner pad may also have a sealing surface opposite from the mounting surface. At least a portion of the sealing surface corresponds with a sealing region designed to seal against a stile of a door panel. A profile of the sealing surface within the sealing region is non-linear. Thus the profile creates a varied thickness of the corner pad within the sealing region to provide varying levels of compression when sealing with the stile, and to accommodate variations in a margin between the frame member and the stile.

8 Claims, 6 Drawing Sheets

CORNER PAD AND ENTRYWAY HAVING THE SAME

FIELD OF THE DISCLOSURE

The present disclosure relates generally to entryways allowing ingress and egress from a building. More particularly, this disclosure relates to sealing pads or strips that help form a watertight seal between a door and one or more frame members of the entryway when the door is closed.

BACKGROUND

Designers seek to avoid exterior doors that stick or catch when being opened or closed. When doors stick, the user is required to assert an undesirably large force to open and close the door. On the other hand, designers seek a tight seal around the door and other entryway components to avoid air drafts or water leaks. A variety of threshold and weather-strip designs exist that attempt to balance the desired seal with the desired movability of a door to varying degrees of success.

A drafty entryway is undesired because the unwanted passage of air from the interior to the exterior of a building, or vice versa, negatively affects the efficiency of heating or cooling the building, increasing the energy costs for the owner.

An entryway that is not properly sealed against water intrusion can lead to infiltration within the interior of the building. The water can cause damage, most often to the interior floor or subfloor, if water is able to get into the building and remain unaddressed. Water infiltration may be particularly acute in a high wind rain storm, where the wind can force rain water against and around a closed door, then through gaps between a closed door and the frame members surrounding the door.

One known system for at least partially sealing around a closed door is disclosed in U.S. Pat. No. 6,219,971, which is commonly owned with the present disclosure. As seen in FIG. 1, the system includes a weather-strip 100 extending vertically along a side jamb 110. The side jamb 110 extends upward from a sill assembly 120. A sealing pad 130 is provided adjacent to the weather-strip 100 just above the sill assembly 120 to assist with a seal of the joint between the side jamb 110, sill assembly 120 and a bottom side edge of a door panel (not shown).

There remains a continued effort to improve the sealing and water management functions of entryway systems to prevent unwanted water intrusion into the interior of a building through gaps around a door panel.

SUMMARY

Embodiments of the present disclosure include a corner pad for an entryway. The corner pad may have a mounting surface configured for attachment to a frame member. The corner pad may also have a sealing surface opposite from the mounting surface. At least a portion of the sealing surface corresponds with a sealing region designed to seal against a stile of a door panel. A profile of the sealing surface within the sealing region is non-linear. Thus the profile creates a varied thickness of the corner pad within the sealing region to provide varying levels of compression when sealing with the stile, and to accommodate variations in a margin between the frame member and the stile.

Other embodiments of the present disclosure include a corner pad comprising a mounting surface configured for attachment to a frame member. The corner pad may also comprise a sealing surface opposite to the mounting surface. At least a portion of the sealing surface corresponds with a sealing region configured to seal against a stile of a door panel. A profile of the sealing surface creates a varied thickness of the corner pad. In these embodiments, a maximum thickness of the corner pad is within the sealing region.

Yet other embodiments of the present disclosure describe an entryway comprising a threshold, a frame member extending upwardly relative to the threshold, a door panel, a weather-strip attached along a height of the frame member, and a corner pad mounted to the frame member adjacent to the threshold. The corner pad comprises a mounting surface configured for attachment to the frame member. The corner pad may also comprise a sealing surface opposite to the mounting surface, where at least a portion of the sealing surface corresponds with a sealing region configured to seal against a stile of the door panel. A profile of the sealing surface within the sealing region is non-linear. This may create a varied thickness of the corner pad within the sealing region to provide varying levels of compression when sealing with the stile, and to accommodate variations in a margin between the frame member and the stile.

These and other aspects of the present invention will become apparent to those skilled in the art after a reading of the following description of the preferred embodiments, when considered in conjunction with the drawings. It should be understood that both the foregoing general description and the following detailed description are explanatory only and are not restrictive of the invention as claimed.

DETAILED DESCRIPTION

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

Figure 2:
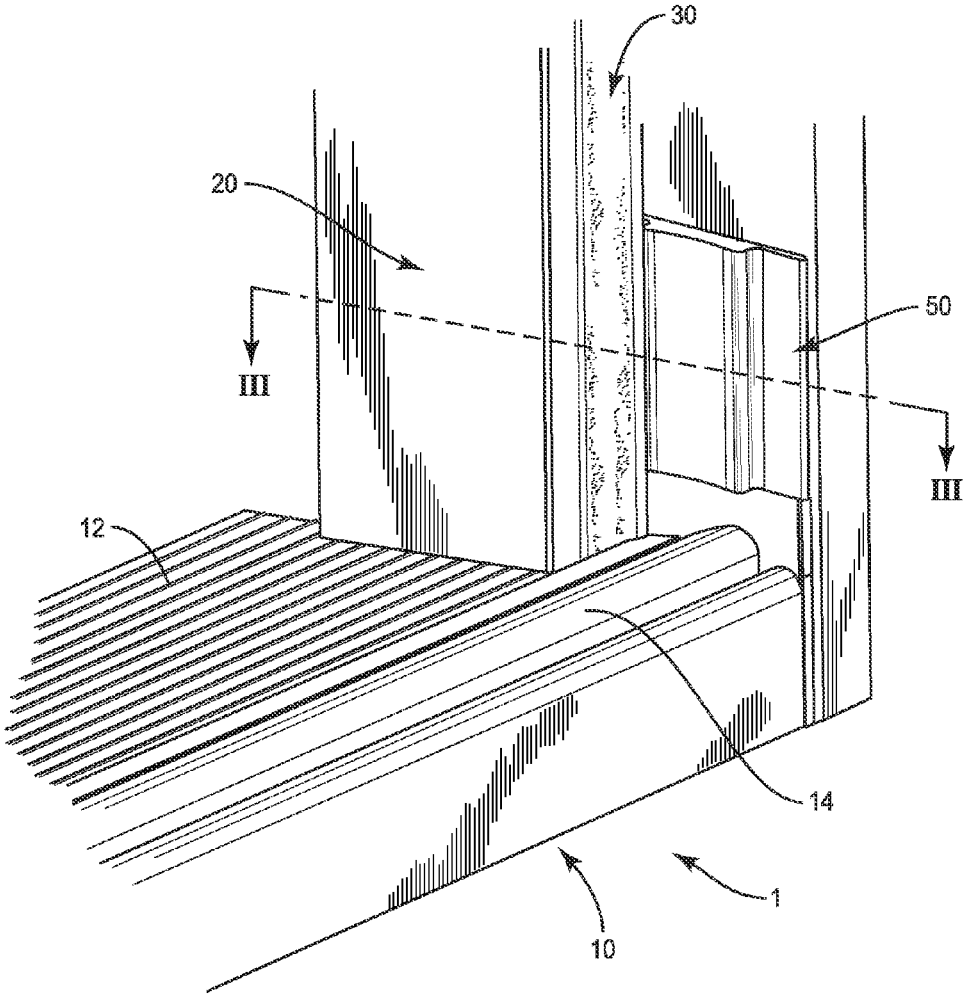
FIG. 2 shows a portion of an entryway according to embodiments of the present disclosure.

Turning to FIG. 2, several elements of a door unit assembly 1 form an entryway through a building or other structure. As previously discussed, the door unit assembly 1 may typically include a threshold 10, a frame member 20, and a weather-strip 30. The threshold 10 may include a sill deck 12 and a cap 14, which may be adjustable. A cap 14 that is adjustable could help accommodate changes or differences in the gap between the threshold 10 and a door panel 40 (see FIG. 4).

In one embodiment, the frame member 20 may be a side jamb extending vertically upward from above or adjacent to the threshold 10. A side jamb is generally a frame member 20 used between the building and the edge of the entryway. The frame member 20 may also be referred to as a mullion, or simply a mull. A mull may have the same or similar inward facing profile as a side jamb. A mull is generally used in a fixed position between door openings or in a fixed position between a door opening and a side-light opening. In yet other embodiments, the frame member 20 may be an astragal attached to a passive door of a double door entryway. The surface of the astragal facing an active door panel 40 may be substantially similar to the side jamb illustrated in FIG. 2.

Figure 3:
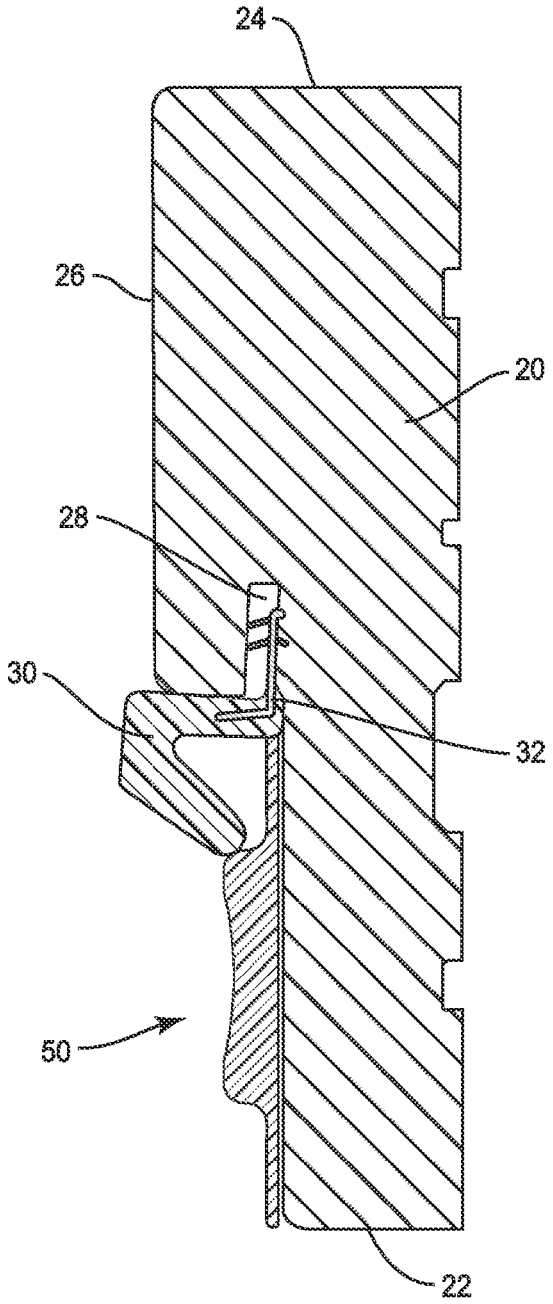
FIG. 3 is a partial cross sectional view of the entryway shown in FIG. 2 through plane III-III.
Figure 4:
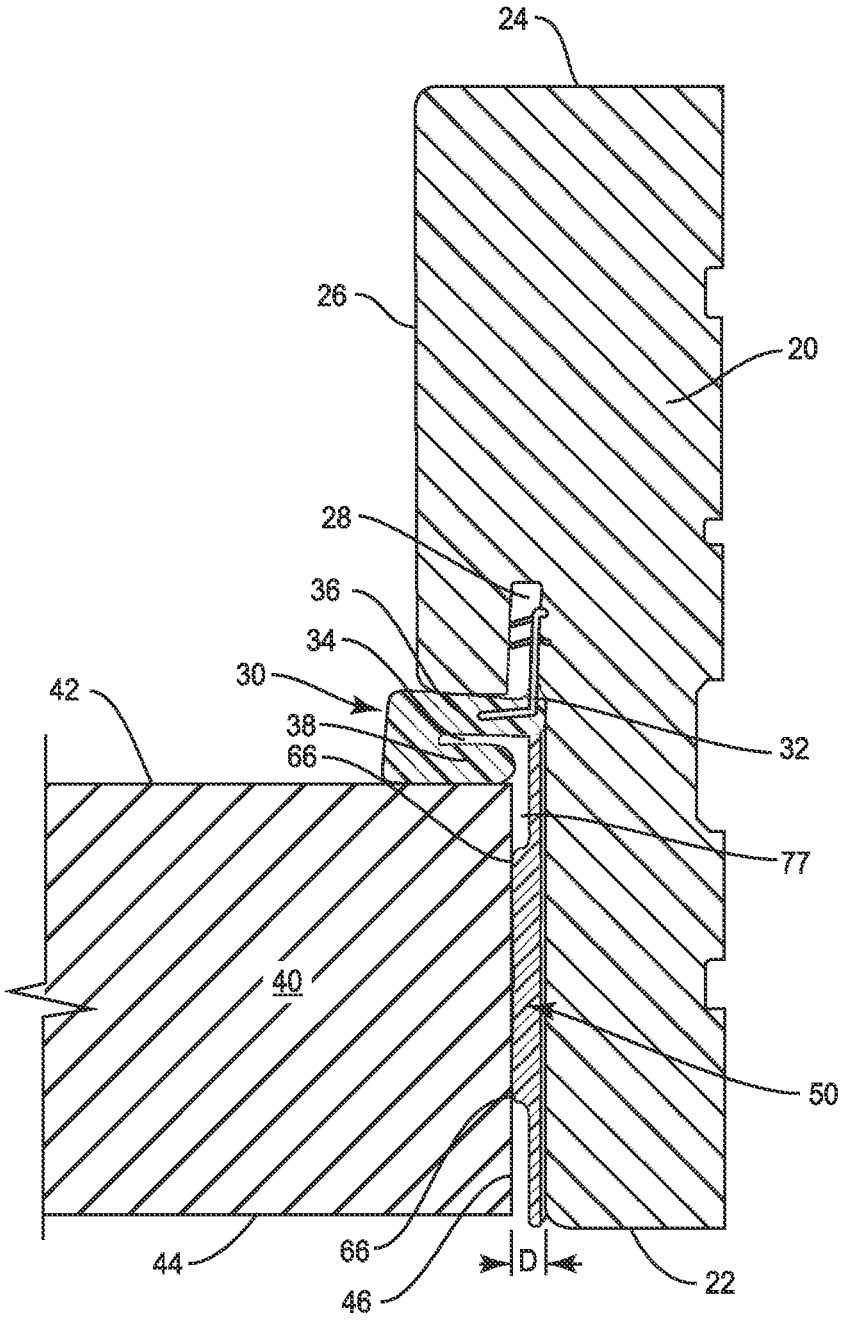
FIG. 4 shows the view of FIG. 3 with a door panel in the closed position.

FIGS. 2-4 illustrate an in-swing door unit. As used herein the terms "interior", "exterior", "inner", etc. are used to describe the relative position of features and elements as they relate to the illustrated in-swing embodiment. These terms found in the specification should not be considered as limiting the scope of the disclosure. Particularly, many of the features and embodiments of the present disclosure may also be applicable to out-swing door units. It will be understood by one of ordinary skill in the art that when applied to an out-swing door unit, the terms "interior", "exterior", etc. may be reversed.

As shown in FIG. 3, the frame member 20 may include an inner edge 22 and an outer edge 24 defined relative to the through-direction of the entryway. The frame member 20 may include a stop portion 26 extending into the entryway opening. The stop portion 26 provides an abutment for the door panel 40 (FIG. 4) and may include a kerf 28 for attachment of the weather-strip 30 to the frame member 20.

Often, a weather-strip 30 extends substantially along the full height of the frame member 20. The weather-strip 30 is compressed by a closed door panel 40 as shown in FIG. 4. The weather-strip 30 seals primarily with the exterior face 42 of the door panel 40 in the illustrated in-swing embodiment. It will be understood by one of ordinary skill in the art that the opposite is true for an out-swing embodiment that remains within the scope of this disclosure. The weather-strip 30 may include an attachment portion 32 configured for mounting of the weather-strip 30 to the frame member 20. The weather-strip 30 may also include an exterior leg 36 and an interior leg 38. The interior leg 38 is flexed by the door panel 40 toward the exterior leg 36 when the door panel 40 is closed.

Continuing with FIG. 4, a door panel 40 may be defined by an exterior face 42, an interior face 44, and stiles 46 extending between edges of the faces 42, 44. One stile may represent a free side of the door panel 40 and an opposite stile may represent a hinged side of the door panel 40. The weather-strip 30 may be positioned to contact one or both of the free and hinged sides of the door panel 40.

As shown in FIGS. 2-6, the present disclosure further comprises a corner pad 50 added to the door unit assembly 1 to improve the seal at the location where the threshold 10, the frame member 20 and the door panel 40 come together. In other words, the corner pad 50 preferably is attached near the bottom of the frame member 20. As discussed above, this location adjacent to the lower corners of a closed door panel 40 is often the most highly susceptible area for water and air intrusion.

Figure 5:
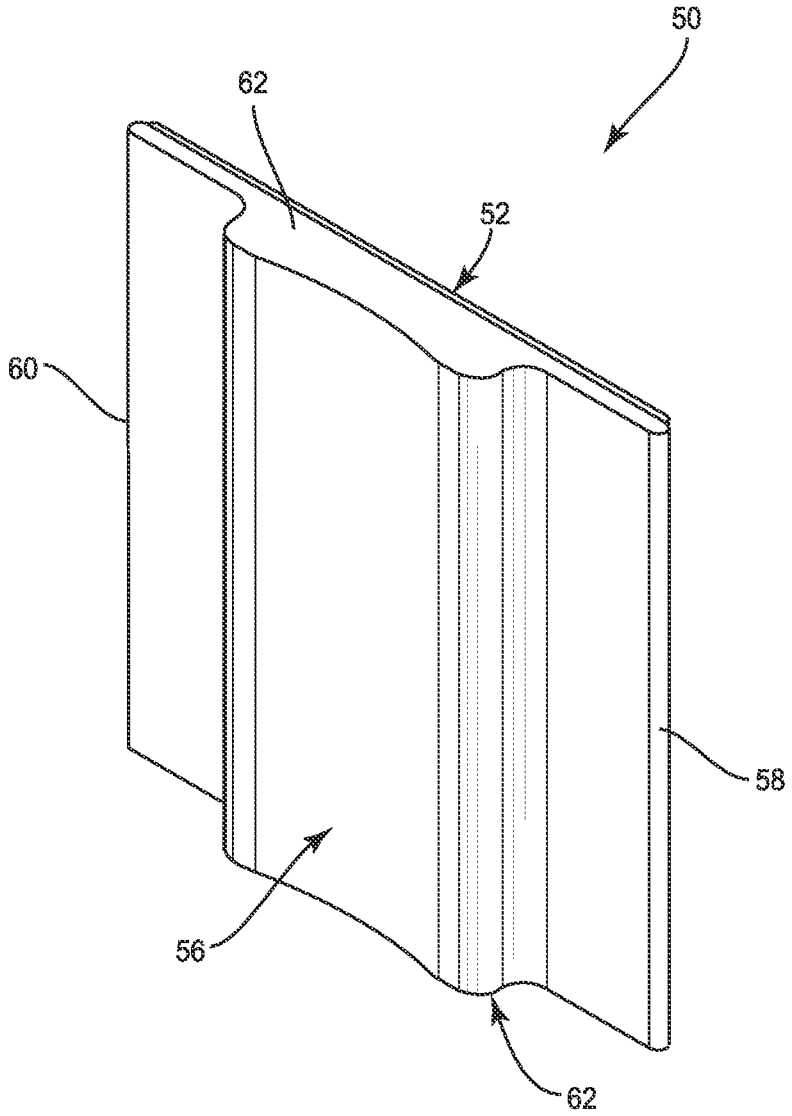
FIG. 5 is a front isometric view of a corner pad according to embodiments of the present disclosure.
Figure 6:
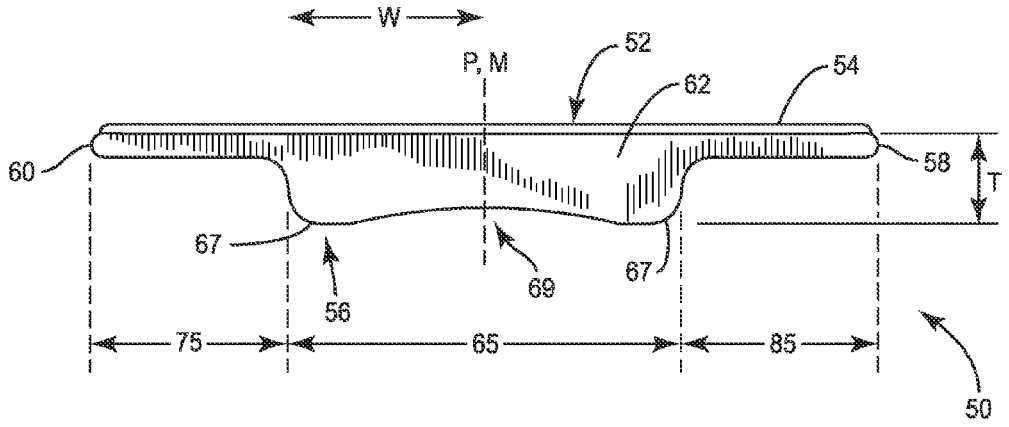
FIG. 6 is a profile view of the corner pad shown in FIG. 5.

As shown in FIGS. 5 and 6, the corner pad 50 includes a mounting surface 52. In one embodiment an adhesive layer 54 is applied to the mounting surface 52. Prior to installation, a paper backing may be provided over the adhesive layer 54 to removably protect the adhesive layer 54. When the paper backing is removed, the adhesive layer 54 may be used to attach the mounting surface 52 to the frame member 20. In some embodiments, the mounting surface 52 will be substantially planar in shape.

The corner pad 50 is used to fill a portion of the gap between the frame member 20 and the stile 46 of the door panel 40. The corner pad 50 may be described in terms of having a sealing surface 56 opposite to the mounting surface 52. The corner pad 50 may also have side surfaces that define opposite edges of the corner pad 50. The edges may be referred to as an interior edge 58 and an exterior edge 60. These names are given for ease of description and not necessarily for limiting the scope of the application. For example, in several embodiments, the corner pad 50 maybe reversible or "non-handed" in which case the interior and exterior sides may be reversed. The corner pad 50 also includes end surfaces 62.

In some embodiments the corner pad 50 is comprised of foam forming a core. All or some of the surfaces of the corner pad 50 may be laminated with a durable cover such as polyethylene. In some embodiments, the foam may be of a low-wick type to reduce the tendency for the foam to absorb moisture.

The corner pad 50 may be described as including one or more regions as shown in FIG. 6. The regions discussed below may be interchangeably referenced with respect to the corner pad 50 or with respect to portions of the sealing surface 56. With this in mind, the corner pad 50 includes at least a sealing region 65. The sealing region 65 will be understood by one of ordinary skill in the art as the region of the corner pad 50 intended to contact the stile 46 of the door panel 40. The sealing region 65 may be considered as extending between the most interior to the most exterior points of contact 66 with the stile 46, as shown in FIG. 4. Therefore not every point between the most interior and most exterior points of contact need to be sealing with the closed door panel 40. Further, any portion of the corner pad 50 that is positioned outward of the exterior face 42 would not generally constitute part of the sealing region 65.

Continuing with the top view of the corner pad 50 as shown in FIG. 6, the profile of the sealing surface 56 can be further described. As shown, the profile of the sealing surface 56 may be non-linear within the sealing region 65. As a result, the thickness T of the corner pad 50, understood as the measured distance from the mounting surface 52 to the sealing surface 56 along a direction perpendicular to the mounting surface 52, varies along the width direction W of the corner pad 50. As should be understood by one of ordinary skill in the art, the thickness T is important for filling the margin D between the stile 46 and the frame member 20, at least in the sealing region 65.

As should be well understood from FIG. 6, the use of a non-linear profile within the sealing region 65 creates a varied thickness of the corner pad 50 within the sealing region 65. When in use with a closed door, the varied thicknesses provide varying levels of compression with the stile 46. Providing areas of varied compression improves the overall seal by accommodating angled or radiused door stile profiles.

Another advantage of designing the sealing region 65 with a varied thickness is that the corner pad 50 is able to accommodate a greater degree of variations in the margin between the frame member 20 and the stile 46. For example, each entryway 1 is designed with an optimal margin D (see FIG. 4). However, assembly, installation, temperature variance, wear, and other factors result in a true margin that is slightly different from the optimal. Many of the factors result in the margin D changing over time.

In the illustrated embodiment of FIGS. 2-6, the profile of the sealing region 65 provides a pair of spaced apart areas of local maximum thickness 67 along the width direction W of the corner pad 50. The areas of local maximum thickness 67 are separated by a thin portion 69 that provides the separation. In the embodiment shown, the thin portion 69 has a concave shape. In other embodiments, three or more areas of local maximum thickness 67 may be provided within the sealing region 65, each separated by a thin portion 69.

Figure 1:
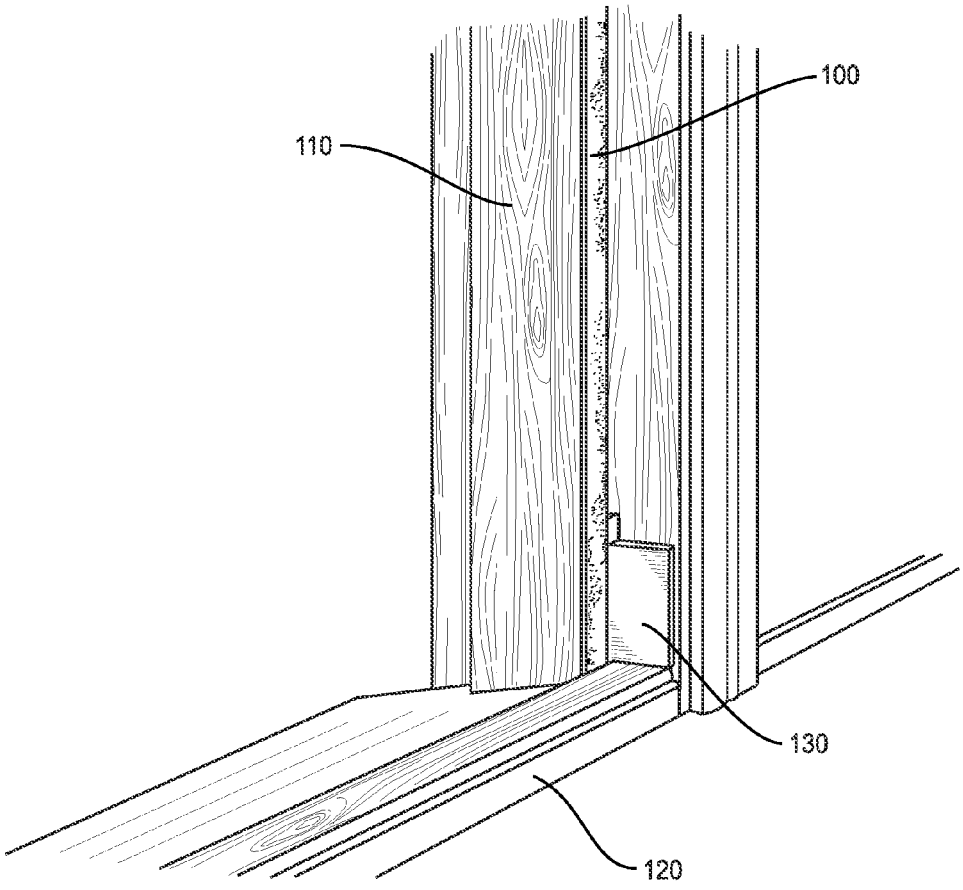
FIG. 1 PRIOR ART
FIG. 1 shows a portion of an entryway according to the prior art.

In still other embodiments, the profile of the sealing region 65 may be solely convex or have a peak between linear sides, resulting in only a single location of maximum thickness within the sealing region 65. While a single location of maximum thickness is contemplated, use of two or more areas of local maximum thickness 67 may result in a widening of the sealing region 65 compared to prior art wedge-shaped sealing pads as shown in FIG. 1. The widening of the sealing region 65 may provide an improved seal. The relative widening of the sealing region 65 may be especially pronounced when the margin D (as shown in FIG. 4) between the door panel 40 and the frame member 20 is relatively large.

The sealing region 65 includes one or more areas of local maximum thickness 67. In one example, the entire sealing region 65 provides the one area of local maximum thickness. In this embodiment, the seal region 65 may be considered as forming a flat-topped plateau relative to a clearance region 75 or a recess region 85 that are discussed below. In most embodiments, at least one of the areas of local maximum thickness 67 within the sealing region 65 will constitute the thickest part of the corner pad 50 overall. Put another way, the thickest portion of the corner pad 50 outside of the sealing region 65, such as within the clearance region 75 or the recess region 85, is thinner than the thickest portion of the corner pad 50 within the sealing region 65.

In some embodiments, the sealing region 65 may be mirror symmetric about a reference plane P that is perpendicular to the mounting surface 52. The reference plane P may be a mid-plane M that bisects the corner pad 50 between the interior edge 58 and the exterior edge 60. When the reference plane P is the mid-plane M, the entire corner pad 50 has mirror symmetry.

In addition to the sealing region 65, the corner pad 50 may include a clearance region 75 adjacent to the exterior edge 60 of the corner pad 50. The exterior edge 60 may be configured to be positioned relatively toward an exterior of an entryway, adjacent to the weather-strip 30. The thickness T of the corner pad 50 within the sealing region 65 is greater than the thickness within the clearance region 75. The clearance region 75 may be described as a thin flange configured to extend behind the weather-strip 30, i.e. between the weather-strip 30 and the frame member 20, as seen in FIGS. 3 and 4. The clearance region 75 extends a distance from the exterior edge 60 that is sufficient to position the sealing region 65 relatively interior to the weather-strip 30 when the exterior edge 60 abuts the attachment portion 32 of the weather-strip 30. Preferably, the clearance region 75 extends a distance from the exterior edge 60 to position the sealing region 65 interior to the interior leg 38 when the interior leg 38 is not compressed.

In one embodiment, the clearance region 75 allows for a sufficient free-space volume to collect moisture adjacent to the weather-strip 30 to counteract the effects of wind driven moisture at the intersection of the threshold 10, the door panel 40 and the frame member 20. Applicants have appreciated that attempts to make a perfect gap-free seal can result in narrow pin-hole gaps due to variations in assembly, installation, or shifting of door components within a door unit assembly 1. Blowing water during a storm, i.e. water under pressure, is then more likely to travel through a pin-hole than through other relatively larger gaps.

As shown in FIG. 4, the corner pad 50 according to some embodiments of the present disclosure leaves open a void 34 between the legs 36, 38 of the weather-strip 30. Additionally, an open volume, referred to herein as a reservoir zone 77, may form in a volume defined between the weather-strip 30 and the sealing region 65 on opposite sides, and between the stile 46 and the clearance region 75 on opposite sides, when the door panel 40 is closed. To provide the reservoir zone 77, it should be appreciated that the thickness of the corner pad 50 along the clearance region 75 is less than the margin D.

The reservoir zone 77 and the void 34 provide a large enough volume that the weight of water held within the volume reduces or eliminates the tendency for wind driven moisture to travel upward, then across the top of the corner pad 50 into the building interior. In most embodiments, the void 34 and the reservoir zone 77 do not have a defined top wall. In some embodiments, when the door panel 40 is closed, the reservoir zone 77 may have a substantially uniform cross section relative to planes perpendicular to the height direction. The substantially uniform cross section should be understood to occur when the corner pad 50, or at least the sealing region 65, is provided with a uniform profile. Put another way, each cross section of the reservoir zone 77 taken parallel with a width direction W of the corner pad 50 at each point along the height of the corner pad 50 is substantially identical.

In some embodiments, the corner pad 50 also includes a recess region 85 as part of the sealing surface 56, as shown in FIG. 6. The recess region 85 may be considered adjacent to the interior edge 58 of the corner pad 50. The recess region 85 provides a thin region relative to the thickness of the sealing region 65. In some embodiments the uncompressed thickness of the recessed region 85 may be less than the width of the margin D.

Providing the thin recess region 85 adjacent to the interior edge 58 allows the door panel 40 to travel further during closing before contacting the corner pad 50. This delays contact between the door panel 40 and the corner pad 50 until the stile 46 contacts the sealing region 65 closer to the final closed position of the door panel 40. As a result, a shear load on the corner pad 50 is provided when the corner pad 50 is engaged with the stile 46 of the door panel 40. The shear load on the adhesive bond between the mounting surface 52 and frame member 20 is better positioned to resist having the corner pad 50 pulled off of the frame member 20 after repeated opening and closing of the door panel 40. In other words, the recess region 85 may minimize the peel action on the adhesive layer 54.

In some embodiments, the recess region 85 may be configured to assist with the proper installation of the corner pad 50 within the door unit assembly 1. For example, the width of the recess region 85 may be sufficient to position the sealing region 65 adjacent the stile 46 when the interior edge 58 is aligned with an inner edge 22 of the frame member 20.

As discussed above, the corner pad 50 may be mirror symmetric with respect to a mid-plane M. When mirror symmetry exists, inclusion of a recess region 85 results in the necessary inclusion of a clearance region 75 of substantially identical structure. As should be understood, if a corner pad 50 with a clearance region 75 is mirror symmetric, the corner pad 50 would necessarily have a recess region 85.

The mirror symmetric embodiment illustrated could provide benefits with respect to the ease of installation and manufacturing. Mirror symmetry allows for the corner pad 50 to be non-handed. This means that the corner pad 50 may be installed on a frame member 20 that forms either the left or right side of an entryway opening. Mirror symmetry also provides for reversibility so that the installer does not have to be concerned with differentiating an interior edge 58 from an exterior edge 60. Further, installers may be provided with positioning cues by aligning the interior edge 58 with the inner edge 22 or abutting the exterior edge 60 with the attachment portion 32. These cues may assist with the proper placement of the sealing region 65 relative to the stile 46 for the optimum seal. The non-handed reversibility of a corner pad 50 that is mirror symmetric may also allow the manufacturer to create and distribute a reduced number of unique parts.

Some embodiments, especially the mirror symmetric embodiment illustrated may also be described has having a uniform profile. Particularly, a cross section taken parallel with the width direction W at any point along the height of the corner pad 50 may produce the same profile. Designing the corner pad 50 with a uniform profile, with or without symmetry, can allow for the shape of the corner pad 50 to be provided by an extrusion process, where each corner pad 50 can then be cut to length, without additional modification to the shape of the corner pads 50.

The corner pad 50 described above may provide for novel methods of installing a corner pad 50 within a door unit assembly 1. These methods may be understood from the preceding disclosure to include alignment of an interior edge 58 of a corner pad 50 with an inner edge 22 of a frame member 20. Additionally or alternatively, the installation may include the method step of aligning or abutting the exterior edge 60 of the corner pad 50 with a portion of a weather-strip 30. These installation methods may or may not be limited to performance by embodiments where the corner pads 50 are mirror symmetric about the mid-plane M.

Use of corner pads 50 from one or more embodiments disclosed herein may facilitate a method of sealing the margin D (as shown in FIG. 4) between a stile 46 and a frame member 20 that uses pooled water to counter wind-blown water from traveling across a top of the seal and into the building. The method may comprise forming a reservoir zone 77 for the accumulation of pooled water between an interior leg 38 of a weather-strip 30 and an exterior boundary of a sealing region 65 of a corner pad 50. The weight of water allowed to pool in the reservoir zone 77 may balance the pressure exerted on the water from the outside air, e.g. the wind during a storm.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

The invention claimed is:

1. An entryway, comprising:

a threshold;

a frame member extending upwardly relative to the threshold;

a door panel;

a weather-strip attached along a height of the frame member; and a corner pad mounted to the frame member adjacent to the threshold, the corner pad comprising:

a mounting surface configured for attachment to the frame member;

a sealing surface opposite the mounting surface, at least a portion of the sealing surface corresponds with a sealing region configured to seal against a stile of the door panel;

a first edge of the corner pad positioned along a portion of the weather-strip; and a second edge of the corner pad located opposite the first edge, wherein a profile of the sealing surface within the sealing region is non-linear, wherein the corner pad further comprises:

a clearance region adjacent to the first edge of the corner pad, wherein a thickness along the sealing region is greater than a thickness along the clearance region, wherein a first open volume is created between the clearance region and the stile when the door panel is closed to at least partially define a first reservoir zone, wherein each cross section of the first reservoir zone taken parallel with a width direction W of the corner pad at each point along the height of the corner pad is substantially identical.

2. The entryway of claim 1, wherein the frame member is a side jamb, a mullion, or an astragal.

3. The entryway of claim 1, wherein a maximum thickness of the corner pad is within the sealing region, and wherein the corner pad is mirror symmetric about vertical and horizontal reference planes perpendicular to the mounting surface.

4. The entryway of claim 1, wherein the sealing region provides at least two spaced apart areas of local maximum thickness along the width direction of the corner pad.

5. The entryway of claim 1, wherein a second open volume is created between the weather-strip and the sealing region when the door panel is closed to at least partially define a second reservoir zone.

6. The entryway of claim 1, wherein the corner pad has a uniform profile such that each cross section of the corner pad taken parallel with the width direction W of the corner pad at each point along the height of the corner pad is substantially identical.

7. The entryway of claim 1, wherein a maximum thickness of the corner pad is within the sealing region.

8. The entryway of claim 1, wherein the sealing region is mirror symmetric about a reference plane perpendicular to the mounting surface.

* * * * *